US006024009A

United States Patent [19]

Morita

[11] Patent Number: 6,024,009

[45] Date of Patent: Feb. 15, 2000

[54] RECIPROCATING PISTONS OF PISTON-TYPE COMPRESSOR

[75] Inventor: Yujiro Morita, Honjo, Japan

[73] Assignee: Sanden Corporation, Gunma, Japan

[21] Appl. No.: 09/080,199

[22] Filed: May 18, 1998

[30] Foreign Application Priority Data

May 16, 1997 [JP] Japan ..... P09-126899

[51] Int. Cl.[7] ..... F01B 3/00

[52] U.S. Cl. ..... 92/12.2; 92/155; 92/172

[58] Field of Search ..... 92/12.2, 71, 155, 92/172, 237

[56] References Cited

U.S. PATENT DOCUMENTS

| | | | |
|---|---|---|---|
| 1,714,145 | 11/1929 | Sperry . | |
| 3,369,458 | 2/1968 | Slimm . | |
| 3,800,675 | 4/1974 | Jacobs . | |
| 3,885,460 | 5/1975 | Park . | |
| 3,982,471 | 9/1976 | Finger . | |
| 4,065,229 | 12/1977 | Black . | |
| 4,073,603 | 2/1978 | Abendschein et al. . | |
| 4,145,163 | 3/1979 | Fogelberg et al. . | |
| 4,174,191 | 11/1979 | Roberts . | |
| 4,351,227 | 9/1982 | Copp, Jr. et al. . | |
| 4,379,425 | 4/1983 | Ishizuka . | |
| 4,416,589 | 11/1983 | Perry . | |
| 4,425,837 | 1/1984 | Livesay . | |
| 4,480,964 | 11/1984 | Skinner . | |
| 4,526,516 | 7/1985 | Swain et al. . | |
| 4,594,055 | 6/1986 | Hatakeyama et al. . | |
| 4,664,604 | 5/1987 | Terauchi . | |
| 5,174,728 | 12/1992 | Kimura et al. . | |
| 5,380,166 | 1/1995 | Terauchi | 417/269 |
| 5,380,167 | 1/1995 | Burkett et al. . | |
| 5,382,139 | 1/1995 | Kawaguchi et al. . | |
| 5,630,353 | 5/1997 | Mittlefehldt et al. . | |
| 5,765,464 | 6/1998 | Morita . | |
| 5,868,556 | 2/1999 | Umemura | 92/71 |
| 5,899,135 | 4/1999 | Kanou et al. | 92/71 |

FOREIGN PATENT DOCUMENTS

| | | |
|---|---|---|
| 3602651 | 7/1987 | Germany . |
| 4207186 | 9/1992 | Germany . |
| 4109481 | 9/1992 | Japan . |
| 7189898 | 7/1995 | Japan . |
| 7189900 | 7/1996 | Japan . |
| 895667 | 5/1962 | United Kingdom . |

*Primary Examiner*—Thomas E. Denion
*Attorney, Agent, or Firm*—Baker Botts, LLP

[57] ABSTRACT

A piston-type compressor has seven cylinder bores formed in a cylinder block which is formed in a compressor housing. A piston is slidably disposed within each of the cylinder bores. Each of the pistons includes a cylindrical main body and an engaging portion axially extending from the cylindrical body. A drive shaft is rotatably supported in the cylinder block. A bearing couples the plate to each of the pistons, so that the pistons reciprocate within the cylinder bores upon rotation of the plate which is tiltably connected to the drive shaft. A recessed portion is formed in an interior of the cylindrical body of each piston so that the cylindrical body forms a C-shaped cross-section perpendicular to longitudinal axis of the piston. Therefore, the configuration obtains lightweight pistons while simultaneously maintaining the efficiency of the compressor.

12 Claims, 5 Drawing Sheets

RECIPROCATING PISTONS OF PISTON-TYPE COMPRESSOR

BACKGROUND OF THE INVENTION

1. Field of the Invention

The present invention relates to a piston-type compressor, in which fluid is compressed by means of reciprocating pistons connected to a swash plate. More particularly, it relates to a configuration of reciprocating pistons, which reduces the weight of the pistons in the refrigerant compressor for an automotive air conditioning system.

2. Description of the Related Art

A variable capacity, swash plate-type compressor is disclosed in U.S. Pat. No. 4,664,604, which is incorporated herein by reference. Referring to FIG. 1, a cylinder block 13 is accommodated in cylinder housing 11 of a compressor 10. Pistons 28 are accommodated in cylinder bores 27 and are reciprocatedly moved therein. A drive shaft 15, which is driven by an engine (not shown), is rotatably supported by means of the central portion of cylinder block 13 and a front cover 22. Rotor plate 18 is mounted on drive shaft 15, and synchronously rotates with draft shaft 15. Further, a swash plate 24 is tiltably mounted on the drive shaft 15 and is reciprocally slidable together with a sleeve 30 parallel to the axis of drive shaft 15. Rotor plate 18 and swash plate 24 are connected to each other by means of a hinge mechanism. Swash plate 24 engages the interior portion of an associated piston 28 along its circumference.

According to the above-described compressor, when drive shaft 15 is rotated, rotor plate 18 rotates together with drive shaft 15. The rotation of rotor plate 18 is transferred to swash plate 24 through the hinge mechanism. Rotor plate 18 is rotated with a surface inclined with respect to drive shaft 15, so that pistons 28 reciprocate in cylinder bores 27, respectively. Therefore, refrigerant gas is drawn into an inlet chamber and compressed and discharged from the inlet chamber into an associated discharge chamber.

Control of displacement of this compressor is achieved by varying the stroke of piston 28. The stroke of piston 28 varies depending on the difference between pressures which are acting on the opposing sides of swash plate 24. The difference is generated by balancing the pressure in a crank chamber acting on the rear surface of piston 28. Consequently, such the suction pressure in cylinder bore 27 acting on the front surface of piston 28, which suction pressure acts on swash plate 24 through piston 28.

In the above-mentioned variable capacity, swash plate-type compressor, it is desirable to reduce the load that is applied to the compressor's drive source, e.g., a vehicle engine. To accomplish this, piston 28 is preferably lightweight. Accordingly, a main body of each piston 28 which reciprocates in cylinder bore 27 is formed with an open space 28*a* therein. A protrusion 29 thereof axially extends from the main body to engage a radial aperture at the periphery of swash plate 24 via sleeve 30.

A second approach to reducing the weight of the pistons is disclosed in unexamined Japanese Utility Patent Publication No. H4-109481, published on Sep. 2, 1992. Referring to FIG. 2, a piston 88, which includes cylindrical body 38*a* and close hollow portion 38*b* therein, is produced, such that at least two separated cylindrical hollow elements are joined together by welding. An arm portion 38*c* extends from cylindrical body 38*a*.

A third approach to reducing the weight of the pistons is disclosed in unexamined Japanese Utility Patent Publication No. H7-18989 and H7-18900, both published on Jul. 28, 1995. Referring to FIGS. 3*a* and 3*b*, a piston 48 has a solid, cylindrical body 48*a*. A first aperture 48*b* and a second aperture 48*c* are formed on the periphery of cylindrical body 48*a*, such that these apertures communicate with each other. Referring to FIG. 4, a piston 58 has a cylindrical body 58*a* and a recessed portion 58*b* formed on a half radial, side surface of cylindrical body 58*a*. Recessed portion 58*b* is scooped out toward the interior of cylindrical body 58*a* of piston 58.

Nevertheless, the pistons discussed above have at least the following disadvantages. In the piston of FIG. 1 described in U.S. Pat. No. 4,664,604, hollow portion 28*a* of piston 28 does not maintain a large capacity therein because a bite of machine metals is not inserted deep into the interior of piston 28 from one axial end of piston 28 toward the longitudinal axis of piston 58. In the piston of FIG. 2 described in unexamined Japanese Utility Patent Publication No. H4-109481, when the piston is produced by a forging machine, closed hollow portion 38*b* of piston 38 is formed by scooping out material from one end portion near the piston head toward an arm portion 38*c* of piston 38. If a welded jointed portion is to be placed near the piston head, cylindrical hollow portion 38*b* near arm portion 38*c* has a smaller radial inner diameter than the piston head. Moreover, inner diameter of cylindrical hollow portion 38*b* gradually decreases toward arm portion 38*c* because a core inserted into cylindrical hollow portion 38*b* for forgoing is drawn out from molding die. Thus, an area having a small diameter is added during the cutting process in order to maintain a uniform diameter and to prevent the above-mentioned disadvantages. Accordingly, this configuration results in increasing the overall weight of piston 38 or in increasing the production cost of piston 38, or both.

On the other hand, if a welded jointed portion is placed near arm portion 38*c*, the frictional force which is generated by the sliding of swash plate 24 within sleeve 30 is transferred to piston 88 and urges piston 38 to rotate around its axis and to include in a radial direction. In particular, because the movement perpendicular to drive shaft 15 and to the longitudinal axis of piston 38 acts on the welded joint portion of cylindrical body 38*a*, the welded joint portion is easily broken.

In the piston of FIGS. 3*a* and 3*b*, described in unexamined Japanese Patent Publication No. H7-189898, and FIG. 4, described in unexamined Japanese Utility Patent Publication No.H7-189900, the radially periphery surface of cylindrical body 48*a* of piston 48, which makes contact with the inner surface of cylinder bore 27, decreases because apertures 48*b* and 48*c* of a recessed portion cover the greater parts of the radial periphery surface of cylindrical body 48*a* or 58*a* of piston 48 or of piston 58, respectively. Therefore, gas compressed within cylinder bore 27 leaks out to the crank chamber because the sealing area decreases between the radial periphery surface of piston 48 or of piston 58, and the inner surface of cylinder bore 27. As a result, the efficiency of the compressor is reduced.

SUMMARY OF THE INVENTION

It is an object of the present invention to provide a piston-type compressor which has lightweight pistons while simultaneously preventing a reduction in the compression efficiency thereof.

It is a further object of the present invention to provide a piston-type compressor which has a piston and a piston ring of superior durability.

It is a still another object of the present invention to provide a piston-type compressor which is simple to manufacture.

According to the present invention, a piston-type fluid displacement apparatus comprises a housing enclosing a crank chamber, a suction chamber, and a discharge chamber. The housing includes a cylinder block and a plurality of cylinder bores formed in the cylinder block. A drive shaft is rotatably supported in the cylinder block. A plurality of pistons are slidably disposed within the cylinder bores. Each of pistons includes a cylindrical body and an engaging portion axially extending from a first axial end of the cylindrical body. A plate having an angle of tilt and tiltably is connected to the drive shaft. A bearing couples the plate to each of the pistons, so that the pistons reciprocates within the cylinder bores upon rotation of the plate. A recessed portion is formed in an interior of the cylindrical body of each piston, so that the cylindrical body forms a C-shape in cross section perpendicular to an longitudinal axis of the piston.

Other objects, features and advantages of this invention will be understood from the following detailed description of preferred embodiments with reference to the attached drawings.

DESCRIPTION OF PREFERRED EMBODIMENTS

Figure 1:
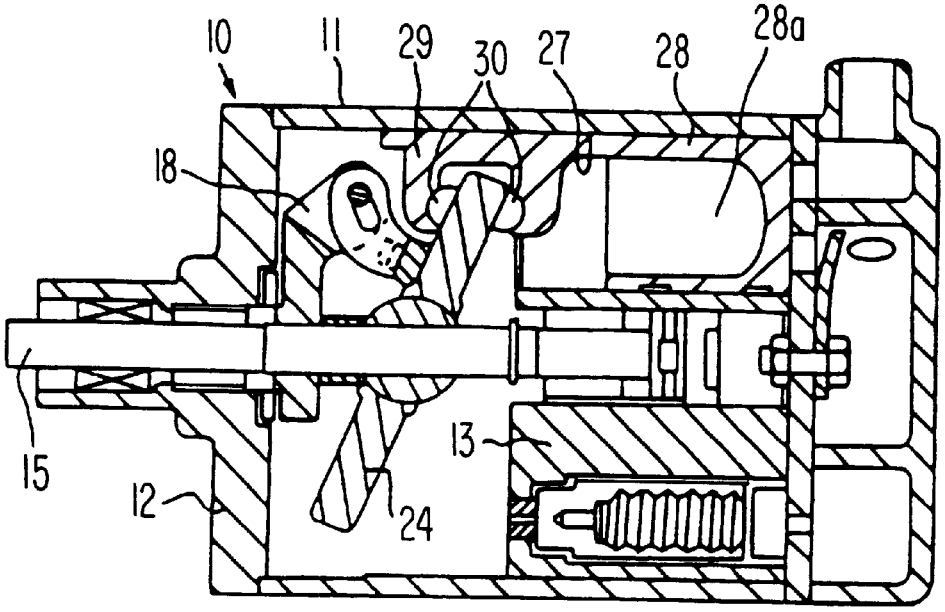
FIG. 1 PRIOR ART
FIG. 1 is a longitudinal cross-sectional view of a swash plate-type refrigerant compressor with a variable displacement mechanism in accordance with a first prior art embodiment.
Figure 2:
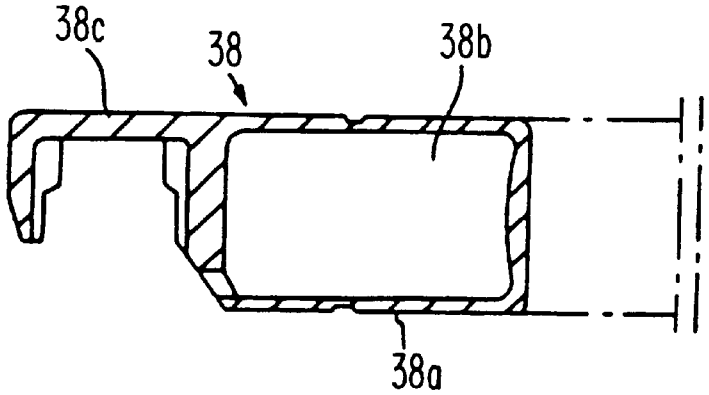
FIG. 2 PRIOR ART
FIG. 2 is a perspective view of a piston in accordance with a second prior art embodiment.
Figure 3A:
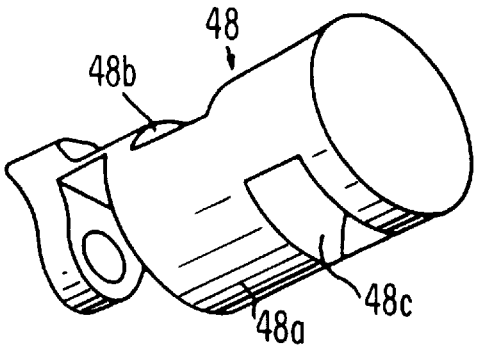
FIG. 3A PRIOR ART
FIG. 3*a* is a perspective view of a piston in accordance with a third prior art embodiment.
Figure 3B:
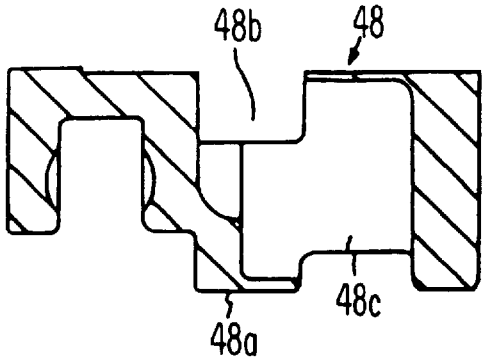
FIG. 3B PRIOR ART
FIG. 3*b* is a longitudinal, cross-sectional view of the piston in accordance with the third prior art embodiment.
Figure 4:
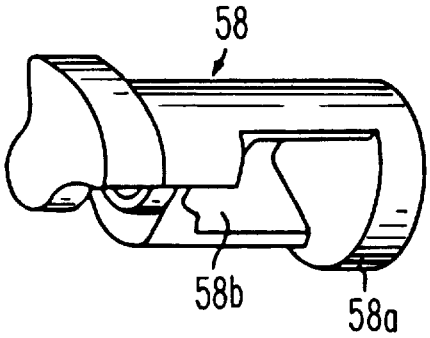
FIG. 4 PRIOR ART
FIG. 4 is a perspective view of a piston in accordance with a fourth prior art embodiment.
Figure 5:
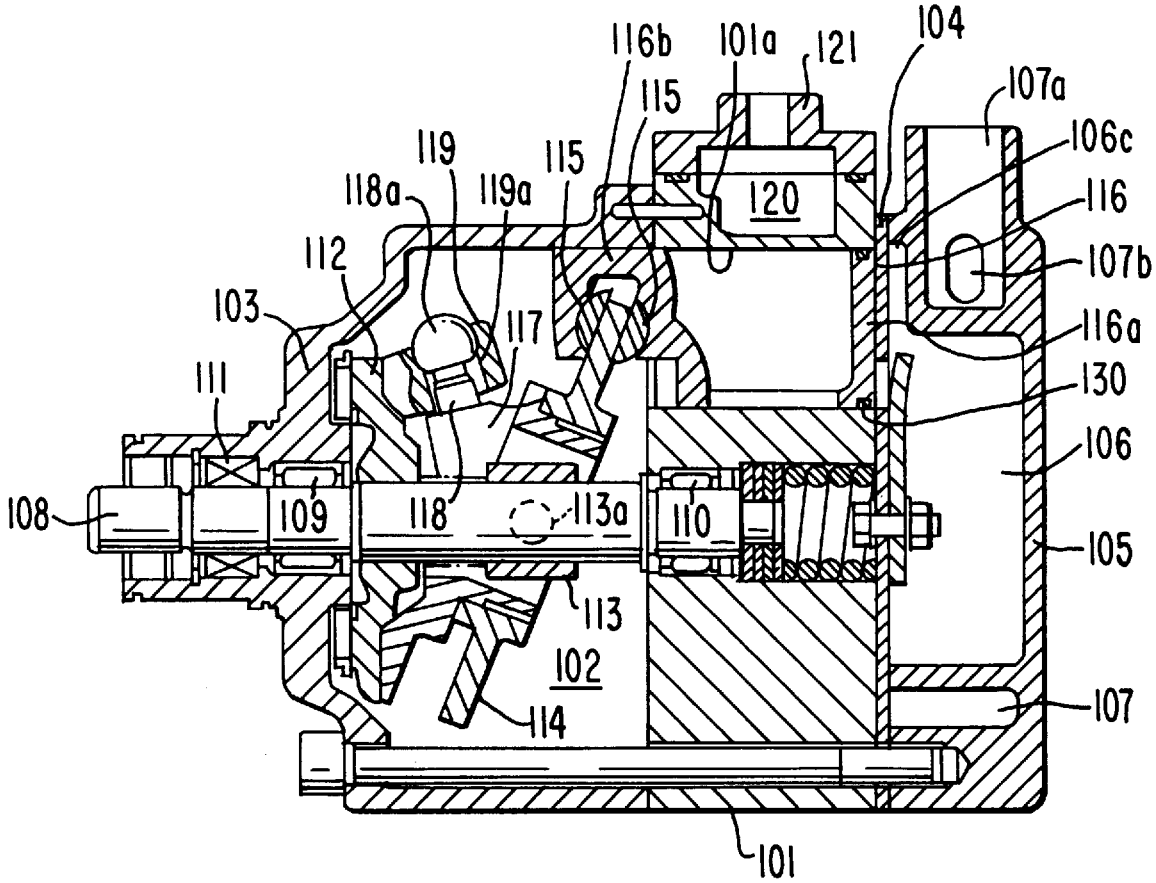
FIG. 5 is a longitudinal, cross-sectional view of a swash plate-type refrigerant compressor with a variable displacement mechanism in accordance with an embodiment of the present invention.

A piston-type compressor, in which fluid is compressed by means of reciprocating pistons connected to a swash plate is described in U.S. patent application Ser. No. 08/816,691, filed on Mar. 13, 1997, which is incorporated herein by reference. Referring to FIG. 5, a swash plate-type compressor is described as a reciprocating compressor according to a first embodiment of the this invention. In the following description, the left side of FIG. 5 will be referred to as front side of the compressor while the right side thereof will be referred to as the rear side of the compressor. These labels are only for the sake of convenience of description and are not intended to limit the invention in any way.

Figure 7:
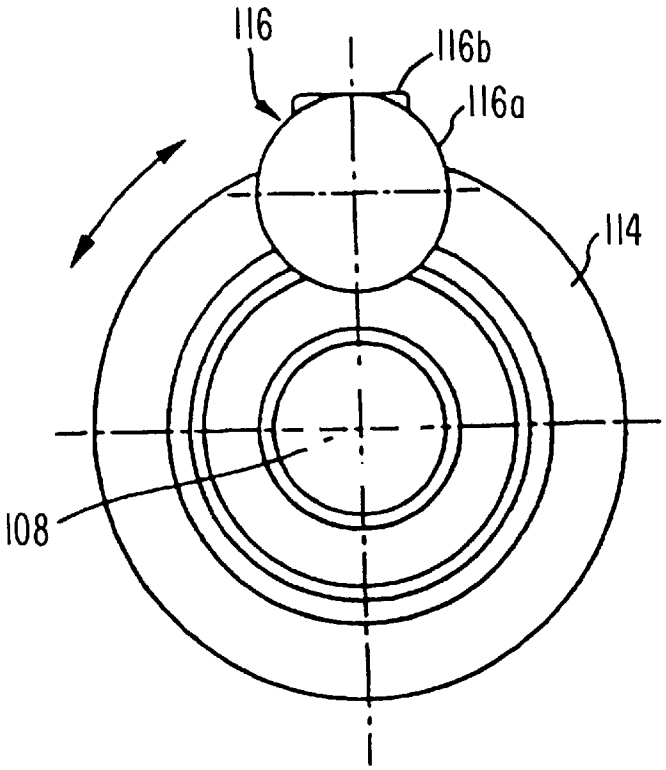
FIG. 7 is an elevation view of a swash plate and piston used in a swash plate-type refrigerant compressor with a variable displacement mechanism in accordance with the embodiment of the present invention.
Figure 6:
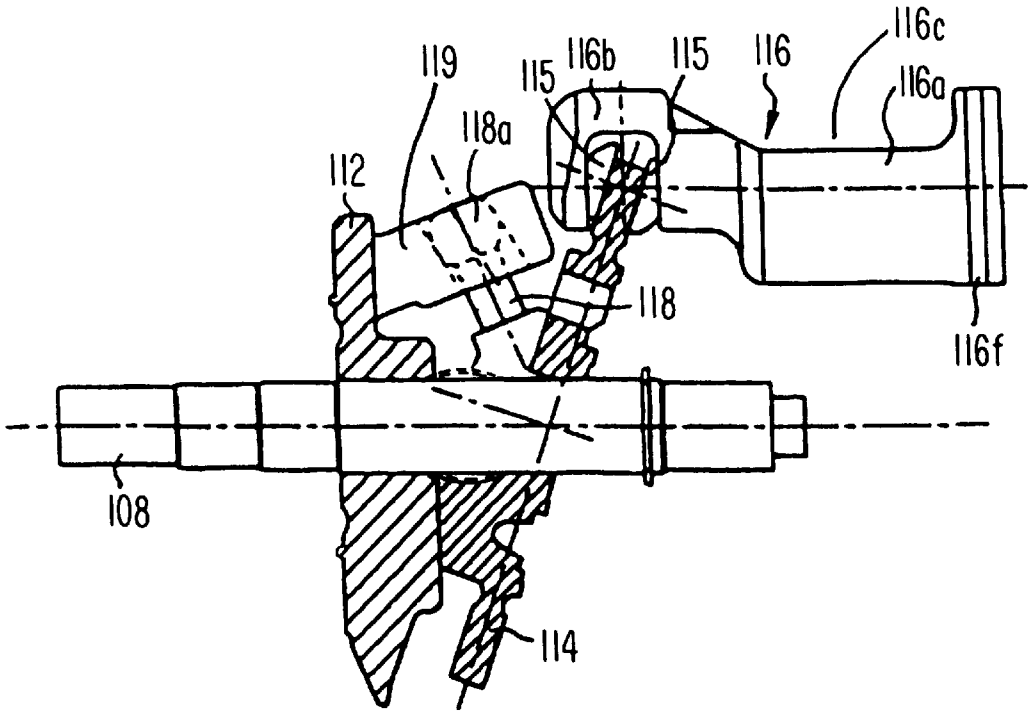
FIG. 6 is a side view of a coupling mechanism between a swash plate and piston used in a swash plate-type refrigerant compressor in accordance with the embodiment of the present invention.

The swash plate-type compressor of FIGS. 5–7 is for use in a vehicle air conditioner and is generally called a single head piston-type. Referring to FIGS. 5–7, in the swash plate-type compressor, a cylinder block 101 is formed therein with seven bores 101*a* arranged circumferentially in parallel to each other and with regular intervals therebetween. A housing 103 includes therein a crank chamber 102 and closes the front end of cylinder block 101. A cylinder head 105 is attached to cylinder block 101 at the rear end thereof with a valve plate 104 interposed therebetween. Cylinder head 105 is formed therein with a discharge chamber 106 at the center thereof and a suction chamber 107 at the peripheral region thereto surrounding discharge chamber 106 on a plane or valve plate 104. Suction chamber 107 has opposite ends which are opposites to each other and are separated by a distance therebetween. Each of bores 101*a* intermittently communicates with each of discharge chamber 106 and suction chamber 107 through valve plate 104 in a motion known in the art.

A drive shaft 108 is supported by radial bearings 109 and 110 which are fixed to housing 103 and cylinder block 101, respectively. A shaft seal unit 111 is disposed in housing 103 for sealing drive shaft 108.

In crank chamber 102, a rotor 112 is fixedly mounted on the drive shaft 108 so as to be rotable with drive shaft 108, whitle a sleeve 113 is loosely and slidably mounted on drive shaft 108. A pair of pivot pins 113*a* are fixed on opposing sides of sleeve 113 and are received in corresponding engaging holes of a screw-assembled swash plate 114, so that swash plate 114 is tiltably supported by sleeve 113. A single head piston 116 is slidably received in each of bores 101*a*. Each piston 116 is formed with a pair of hemispherical concave portions facing each other and slidably receiving hemispherical shoes 115. Further, swash plate 114 is slidably held between shoes 115, and, thus, each piston 116 is coupled to swash plate 114 through hemispherical engagement between shoes 115 and the corresponding concave portions of each piston 116 inserted therein. Shoes 115 and the corresponding concave portions of each piston 116 are referred to as a compression element.

Referring again to FIGS. 6 and 7, on the front side of swash plate 114, a pair of brackets 117 are fixedly mounted with a top deal center position of swash plate 114 located therebetween. A guide pin 118 has a spherical head 118*a* and is fixed on each bracket 117. On the other hand, at the back of rotor 112, a pair of support arm 119 are provided, so as to receive spherical heads 118*a* of the corresponding guide pins 118 in holes 119*a* formed through the corresponding support arm 119. Although the motion of swash plate 114 is regulated by engagement between spherical heads 118*a* of guide pins 118 and holes 119*a* of support arm 119, the central inclination of each hole 119*a* is so set as to rotatably hold the top position of each piston 116. A combination of the rotor 112, sleeve 113, and swash plate 114 is operable as a swash-plate element. Brackets 117 and support arms 119 form a hinge mechanism in cooperation with each other.

Figure 8:
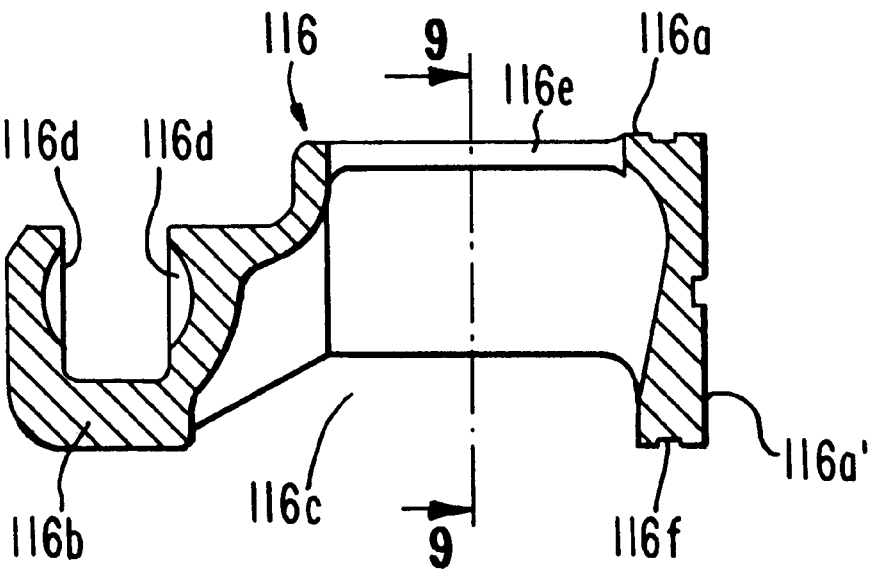
FIG. 8 is an enlarged sectional view of a piston assembly used in a swash plate-type refrigerant compressor in accordance with the embodiment of the present invention.

Referring to FIG. 8, piston 116 includes an open space 116*c* formed in a piston head 116*a*', such that open space 116*c* extends to the center axis of piston 116. Piston 116 includes an aperture 116*e* formed on piston head 116*a* opposite to open space 116*c*, such that aperture 116*e* fluidly communicates with open space 116*c* to discharge lubricating oil. Further, piston 116 includes, an annular groove 116*f* formed on periphery surface of cylindrical body 116*a* for receiving a piston ring 130.

Figure 9:
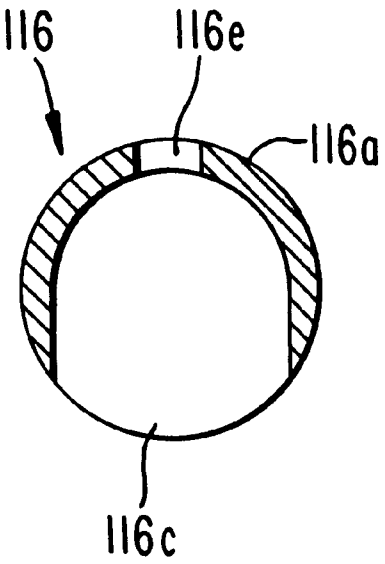
FIG. 9 is an enlarged sectional view of a piston assembly used in a swash plate-type refrigerant compressor taken along line 9—9 of FIG. 8.

Referring to FIG. 9, open space 116*c* is formed, so that piston head 116*a* has a C-shape in a radial cross-section. Aperture 116*e* functions to discharge lubricating oil stored therein. Piston 116 includes a pair of semi-spherical pockets 116*d* formed on connecting portion 116*b* for engaging shoes 115. In addition, piston 116 may be made of aluminum alloy. Cylindrical body 116*a* is coated with a coating comprising a self lubricating material, such as polytetrafluoroethhylene (hereinafter "PTFE"). Further, piston ring 130 also may be made from a resin, such as an engineering plastic comprising PTFE. Cylinder block 101 may be made of aluminum alloy or a steel. Thus, the slidable relationship between the parts described above may be improved if a combination of materials and coatings of cylinder block 101 and piston 116 or piston ring 180 are properly selected.

When the compressor is activated, a rotary motion of drive shaft 108 is transferred to swash plate 114 via rotor 112 and guide pins 118. Thus, each piston 116 reciprocates within the corresponding bore 101*a*, so that the suction gas is introduced into the corresponding bore 101*a*, then compressed and discharged as discharge gas into discharge chamber 106. Depending on a pressure differential between the pressure in crank chamber 102 and that in suction chamber 107, the inclination of the swash plate 114 and, consequently, the stroke of piston 116 are changed to control the capacity of the compressor in the manner known in the art. The pressure in crank chamber 102 is controlled by a control valve mechanism (not shown) provided in cylinder head 105 depending on the heat load.

The high pressure, discharge gas is discharged into discharge chamber 106, from respective bores 101*a* and is introduced into a pressure supporting chamber 120 through a discharge gas conducting passage 106*c* and communication hole (not shown). The pressure pulsation components of discharge gas are attached by an expansion muffler function of pressure suppressing chamber 120. Then, the discharge gas is delivered out to a connected cooling circuit (not shown) through a discharge port 121. On the other hand, the refrigerant gas is introduced as the suction gas into suction chamber 107 through a suction gas inlet passage 107*a* from the exterior of cylinder head 105. Upon introduction, the suction gas is divided to flow into suction chamber 107 via outlet ports 107*b*.

In the above mentioned configuration of piston 116, the axial length of piston 116 may be short because piston ring 130 is disposed in annular groove 116*f* to maintain the seal between the periphery surface of piston and the inner surface of cylinder bore 101*a*. As a result, piston 116 is lightweight while simultaneously maintaining the compression efficiency of a compressor. The construction of piston 116 may reinforce a weakness of cylindrical body 116*a* of piston 116 while simultaneously being lightweight because cylindrical body 116*a* has a C-shaped in cross-section in the direction perpendicular to longitudinal center axis of piston 116. Further, the configuration of piston 116 results in reduced production costs due to integrally forming piston 116. In particular, a clearance created between cylinder bore 101*a* and the peripheral surface of piston 116 is more easily controlled in production.

Thus, the radial direction moment is generated by sliding of swash plate 114 within sleeve 116 and perpendicular to drive shaft 108 and the longitudinal axis of piston 116. This moment to cause piston 116 to incline within cylinder bore 101*a*. However, piston 116 and piston ring 130 may increase the durability and life of pistons 116 and cylinder bores 101*a* because the PTFE coating of piston 116 and the resin of piston ring 130 eases this moment.

Although the present invention has been described in connection with preferred embodiments, the invention is not limited thereto. Specifically, while the preferred embodiments illustrate the invention in a swash plate-type compressor, this invention is not restricted to swash plate-type compressors, but may be employed in other piston-type compressors or a piston-type fluid displacement apparatus. Accordingly the embodiments and features disclosed herein are provided by way of example only. It will be understood by those of ordinary skill in the art that variations and modifications may be made within the scope of this invention as defined by the following claims.

What is claimed is:

1. A piston-type fluid displacement apparatus comprising:

a housing enclosing a crank chamber, a suction chamber, and a discharge chamber, said housing including a cylinder block wherein a plurality of cylinder bores are formed;

a drive shaft rotatably supported in said cylinder block;

a plurality of pistons, each of which is slidably disposed within one of said cylinder bores, each of said pistons including a cylindrical body and an engaging portion axially extending from a first axial end of said cylindrical body;

a plate having an angle of tilt and tiltably connected to said drive shaft;

a bearing coupling said plate to each of said pistons, so that said pistons reciprocates within said cylinder bores upon rotation of said plate; and a recessed portion formed in an interior of said cylindrical body of each said piston, said recessed portion extending from said engaging portion to a head of said piston, so that said cylindrical body has a C-shaped cross-section perpendicular to a longitudinal axis of said piston.

2. The piston-type fluid displacement apparatus of claim 1, wherein said piston includes an aperture formed in a periphery surface of said cylindrical body, so that said aperture is in fluid communication with said recessed portion of said piston.

3. The piston-type fluid displacement apparatus of claim 1, wherein said cylindrical body of said piston includes a periphery surface coated with a self-lubricating coating.

4. The piston-type fluid displacement apparatus of claim 3, wherein said self-lubricating coating is polytetrafluoroethylene.

5. The piston-type fluid displacement apparatus of claim 1, wherein said piston includes at least one annular groove formed on said periphery surface of said cylindrical body.

6. The piston-type fluid displacement apparatus of claim 5, wherein said piston includes at least one piston ring disposed in said annular groove.

7. The piston-type fluid displacement apparatus of claim 6, wherein said at least one piston ring comprises a self-lubricating material.

8. The piston-type fluid displacement apparatus of claim 7, wherein said self-lubricating material is polytetrafluorethhylene.

9. The piston-type fluid displacement apparatus of claim 3, wherein said piston includes at least one annular groove formed on said periphery surface of said cylindrical body.

10. The piston-type fluid displacement apparatus of claim 9, wherein said piston includes at least one piston ring disposed in said annular groove.

11. The piston-type fluid displacement apparatus of claim 10, wherein said at least one said piston ring comprises a self-lubricating material.

12. The piston-type fluid displacement apparatus of claim 11, wherein said self-lubricating material is polytetrafluoro-ethhylene.

* * * * *